US010520854B2

(12) United States Patent
Amano

(10) Patent No.: US 10,520,854 B2
(45) **Date of Patent: *Dec. 31, 2019**

(54) CARTRIDGE

(71) Applicants: KABUSHIKI KAISHA TOSHIBA, Tokyo (JP); TOSHIBA TEC KABUSHIKI KAISHA, Tokyo (JP)

(72) Inventor: Takafumi Amano, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/224,660

(22) Filed: Dec. 18, 2018

(65) Prior Publication Data

US 2019/0294079 A1 Sep. 26, 2019

Related U.S. Application Data

(63) Continuation of application No. 15/927,811, filed on Mar. 21, 2018, now Pat. No. 10,180,638.

(51) Int. Cl.
*G03G 15/08* (2006.01)

(52) U.S. Cl.
CPC ..... *G03G 15/0881* (2013.01); *G03G 15/0891* (2013.01)

(58) Field of Classification Search
CPC ..... G03G 15/0881; G03G 15/0891
See application file for complete search history.

(56) References Cited

U.S. PATENT DOCUMENTS

| | | | |
|---|---|---|---|
| 9,996,025 | B1 | 6/2018 | Amano |
| 2016/0054681 | A1 | 2/2016 | Eto et al. |
| 2016/0062268 | A1 | 3/2016 | Nakaue et al. |

FOREIGN PATENT DOCUMENTS

| | | | |
|---|---|---|---|
| JP | 2001175080 | A | 6/2001 |
| JP | 2004177645 | A | 6/2004 |

*Primary Examiner* — Hoang X Ngo
(74) *Attorney, Agent, or Firm* — Kim & Stewart LLP

(57) ABSTRACT

A cartridge for mounting in an image forming apparatus includes a developer storage chamber, a discharge port fluidly connected to the developer storage chamber, a toner storage chamber, a fluid communication path extending in a first direction and fluidly connecting the toner storage chamber to the developer storage chamber, an auger disposed in the fluid communication path, rotatable inside the fluid communication path about a rotation axis extending in the first direction, and configured to transport the toner from the toner storage chamber along the fluid communication path toward the developer storage chamber when rotated about the rotation axis, and a sealing member disposed on the auger and configured to seal a gap between the auger and an inner surface of the fluid communication path when the sealing member is inside the fluid communication path and move along the first direction when the auger is rotated about the rotation axis.

20 Claims, 8 Drawing Sheets

CARTRIDGE

CROSS-REFERENCE TO RELATED APPLICATIONS

This application is a continuation of U.S. patent application Ser. No. 15/927,811, filed on Mar. 21, 2018, the entire contents of which are incorporated herein by reference.

FIELD

Embodiments described herein relate generally to a cartridge.

BACKGROUND

An image forming apparatus includes a developing device that accommodates a two-component developer that comprises a carrier and a toner. The image forming apparatus forms an electrostatic latent image on a surface of a photoconductive drum by supplying the two-component developer to the surface of the photoconductive drum. The developing device is filled with the two-component developer from a developer cartridge at the time of initial setup. During an operation of the image forming apparatus, the developing device is supplied with toner from a toner cartridge as needed. When the image forming apparatus is shipped, the developer cartridge and the toner cartridge are typically bundled with the image forming apparatus. Accordingly, there is a possibility that product cost may increase. Therefore, to suppress an increase in the product cost, it is conceivable to adopt a method in which the toner is accommodated within the developer cartridge separately from the developer rather than provided in a different cartridge. However, in this case, there is a possibility that the developer and the toner may be improperly mixed with each other inside the single developer cartridge.

DETAILED DESCRIPTION

A cartridge for mounting in an image forming apparatus includes a developer storage chamber, a discharge port fluidly connected to the developer storage chamber, a toner storage chamber, a fluid communication path extending in a first direction, the fluid communication path fluidly connecting the toner storage chamber to the developer storage chamber, an auger disposed in the fluid communication path, the auger being rotatable inside the fluid communication path about a rotation axis extending in the first direction and configured to transport the toner from the toner storage chamber along the fluid communication path toward the developer storage chamber when rotated about the rotation axis, and a sealing member disposed on the auger and configured to seal a gap between the auger and an inner surface of the fluid communication path when the sealing member is inside the fluid communication path and move along the first direction when the auger is rotated about the rotation axis.

Hereinafter, an image forming apparatus and a cartridge according to example embodiments will be described with reference to the drawings.

Figure 1:
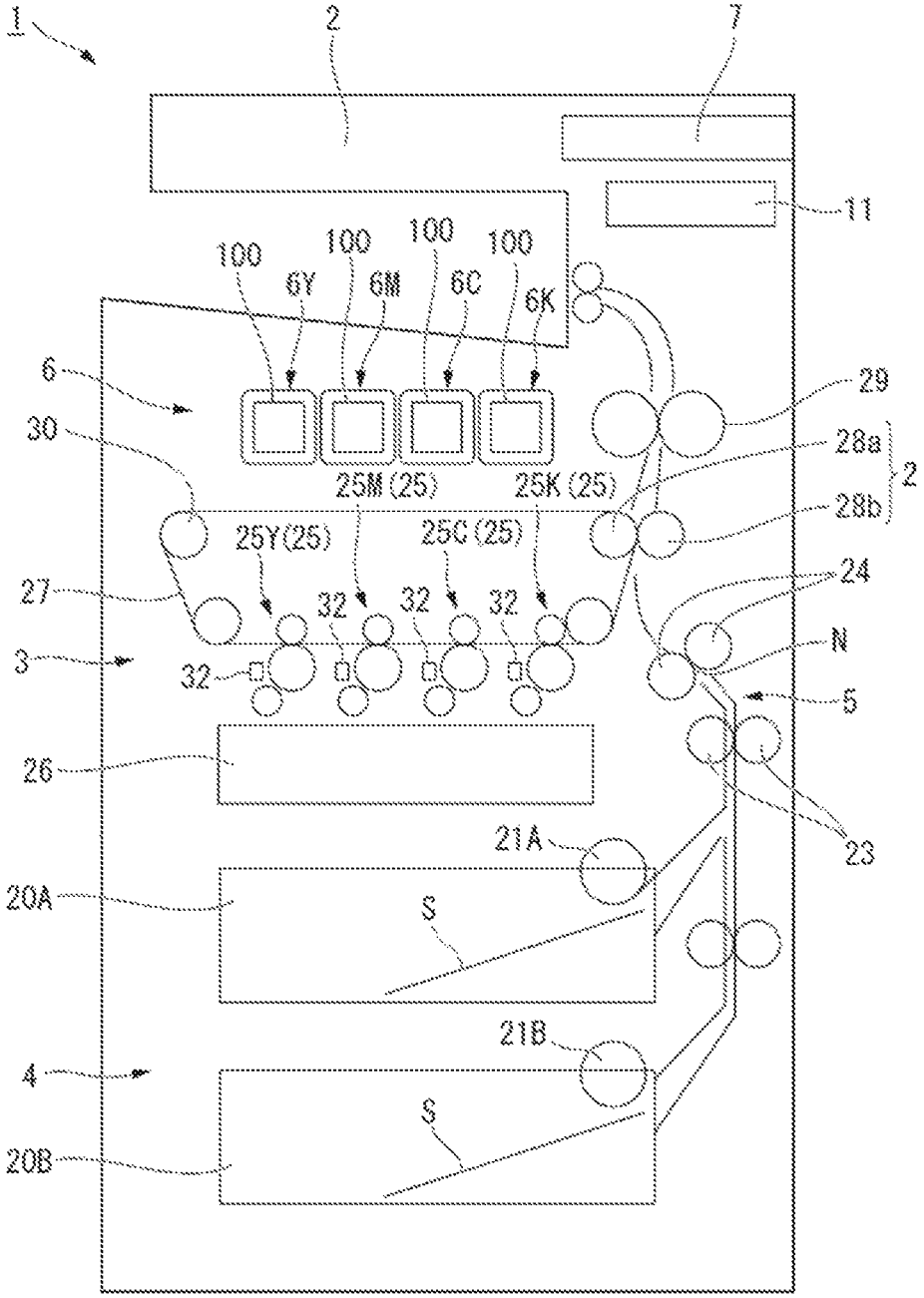
FIG. 1 is a schematic diagram of an image forming apparatus according to an embodiment.

FIG. 1 is a schematic diagram of the image forming apparatus according to an embodiment.

As illustrated in FIG. 1, an image forming apparatus has a scanner unit 2, a printer unit 3, a sheet accommodation unit 4, a transport unit 5, a toner supply unit 6, a display unit 7, and a control unit 11. In the example of the image forming apparatus 1 described, the image forming apparatus 1 is assumed to be placed on a horizontal plane. A side of the image forming apparatus 1 illustrated in FIG. 1 is referred to as a front side, and a side opposite thereto is referred to as a rear side. A longitudinal direction is along a depth of the image forming apparatus 1 from the front side to the rear side. A direction orthogonal to the longitudinal direction and parallel to a height direction (up-down page direction in FIG. 1) of the image forming apparatus 1 is referred to as a vertical direction. A direction orthogonal to the longitudinal direction and the vertical direction is referred to as a lateral direction.

The scanner unit 2 reads image information of an object to be copied as light brightness and darkness. The scanner unit 2 outputs the read image information to the control unit 11.

The sheet accommodation unit 4 supplies sheets S to the printer unit 3 one by one. The sheet accommodation unit 4 has a plurality of paper feeding cassettes 20A and 20B. Each of the paper feeding cassettes 20A and 20B accommodates sheets S whose sizes and types can be set in advance. The paper feeding cassettes 20A and 20B respectively have pickup rollers 21A and 21B. Each of the pickup rollers 21A and 21B fetches the sheets S individually from the paper feeding cassettes 20A and 20B, respectively. The pickup rollers 21A and 21B supply the fetched sheets S to the transport unit 5.

The transport unit 5 has a transport roller 23 and a registration roller 24. The transport unit 5 transports the sheets S supplied by the pickup rollers 21A and 21B to the registration roller 24. The registration roller 24 transports the sheet S in accordance with the timing at which the printer unit 3 transfers an output image (hereinafter, referred to as a "toner image") to the sheet S. In the transport roller 23, a leading edge of the sheet S in a transporting direction comes into contact with a nip N of the registration roller 24. The transport roller 23 bends the sheet S, thereby aligning a position of the leading edge of the sheet S delivered from the transport roller 23 in the transporting direction. The registration roller 24 aligns the leading edge of the sheet S delivered from the transport roller 23 to the nip N. Furthermore, the registration roller 24 transports the sheet S toward a transfer unit 28.

Based on the image information scanned by the scanner unit 2 or received from outside of the image forming apparatus 1, the printer unit 3 forms the toner image by using a developer including a toner. The printer unit 3 transfers the toner image onto a surface of the sheet S. The printer unit 3 applies heat and pressure to the toner image on the surface of the sheet S, thereby fixing the toner image onto the sheet S.

Hereinafter, the printer unit 3 will be described in further detail.

The printer unit 3 has image forming units 25Y, 25M, 25C, and 25K, each of which may also be referred to as an "individual image forming unit 25," an exposure unit 26, an intermediate transfer belt 27, a transfer unit 28, a fixing device 29, and a toner concentration sensor 32.

The individual image forming unit 25 forms the toner image to be transferred to the sheet S on the intermediate transfer belt 27. The intermediate transfer belt 27 is an endless belt (a loop). A tensile force is applied to the intermediate transfer belt 27 by a plurality of rollers in contact with an inner peripheral surface of the intermediate transfer belt 27. The intermediate transfer belt 27 is stretched to be flat. The inner peripheral surface of the intermediate transfer belt 27 comes into contact with a support roller 28*a* and a transfer belt roller 30 at a position farthest away from the support roller 28*a* in a stretching direction of the intermediate transfer belt 27.

The support roller 28*a* is a portion of the transfer unit 28. The support roller 28*a* guides the intermediate transfer belt 27 to a secondary transfer position.

The transfer belt roller 30 guides the intermediate transfer belt 27 to a cleaning position.

The image forming units 25Y, 25M, 25C, and 25K are disposed in this order from the transfer belt roller 30 toward the transfer unit 28 on a lower side of the intermediate transfer belt 27. The individual image forming units 25 are disposed so as to be apart from each other in a region between the transfer belt roller 30 and the support roller 28*a*.

The individual image forming units 25 each have a photoconductive drum. Each photoconductive drum is rotated in synchronization with the rotation of the intermediate transfer belt 27.

A charging device, a developing device, a transfer roller, a photoconductive cleaning unit, and a charge eliminator are disposed around each photoconductive drum.

The developing devices of the individual image forming units 25 selectively supply the toner to the surface of each photoconductive drum. The developing devices respectively accommodate yellow, magenta, cyan, and black toners. The developer including the toner and the carrier is accommodated in each developing device. The developer including a toner and a carrier may also be referred to as a "two-component developer." The toner concentration in the developer is referred to as "toner concentration ratio". The toner concentration ratio in each developing device can be measured by a toner concentration sensor 32. For example, the toner concentration sensor 32 is a magnetic sensor.

The exposure unit 26 faces the photoconductive drum of the individual image forming unit 25. The exposure unit 26 emits light from an LED, which is controlled based on the image information, onto the surface of the photoconductive drum of the individual image forming units 25. The exposure unit 26 can also adopt a configuration in which laser light is emitted from a laser light source. Yellow, magenta, cyan, and black image information is supplied to the exposure unit 26. Based on the yellow, magenta, cyan, and black image information, the exposure unit 26 emits light onto each photoconductive drum of the individual image forming units 25 after the photoconductive drums have been electrostatically charged. The exposure unit 26 thus forms an electrostatic latent image on the surface of each photoconductive drum according to the supplied image information.

The image forming unit 25 then develops the electrostatic latent image by using the toners. The image forming unit 25Y forms a yellow toner image on the surface of a photoconductive drum. The image forming unit 25M forms a magenta toner image on the surface of a photoconductive drum. The image forming unit 25C forms a cyan toner image on the surface of a photoconductive drum. The image forming unit 25K forms a black toner image on the surface of a photoconductive drum.

The individual image forming unit 25 transfers the toner images formed on the surface of the photoconductive drum onto the intermediate transfer belt 27. This transfer of the toner images onto the intermediate transfer belt 27 may be referred to as a primary transfer and the positions at which the toner images are transferred onto the intermediate transfer belt 27 are referred to as primary transfer positions. The individual image forming units 25 respectively apply a transfer bias to the toner image at each primary transfer position. The individual image forming unit 25 superimposes the toner images of the respective colors on the intermediate transfer belt 27, and transfers the toner images. The individual image forming unit 25 forms the color toner images on the intermediate transfer belt 27.

The transfer unit 28 is disposed at a position adjacent to the image forming unit 25 in the intermediate transfer belt 27.

The transfer unit 28 transfers the toner image on the intermediate transfer belt 27 to the surface of the sheet S at the secondary transfer position. Here, the secondary transfer position refers to a position where the support roller 28*a* and a secondary transfer roller 28*b* face each other. The transfer unit 28 provides the secondary transfer position with a transfer bias controlled by a transfer current. The transfer unit 28 transfers the toner image to the sheet S by using the transfer bias.

The fixing device 29 fixes the toner image to the sheet S by applying heat and pressure.

Figure 2:
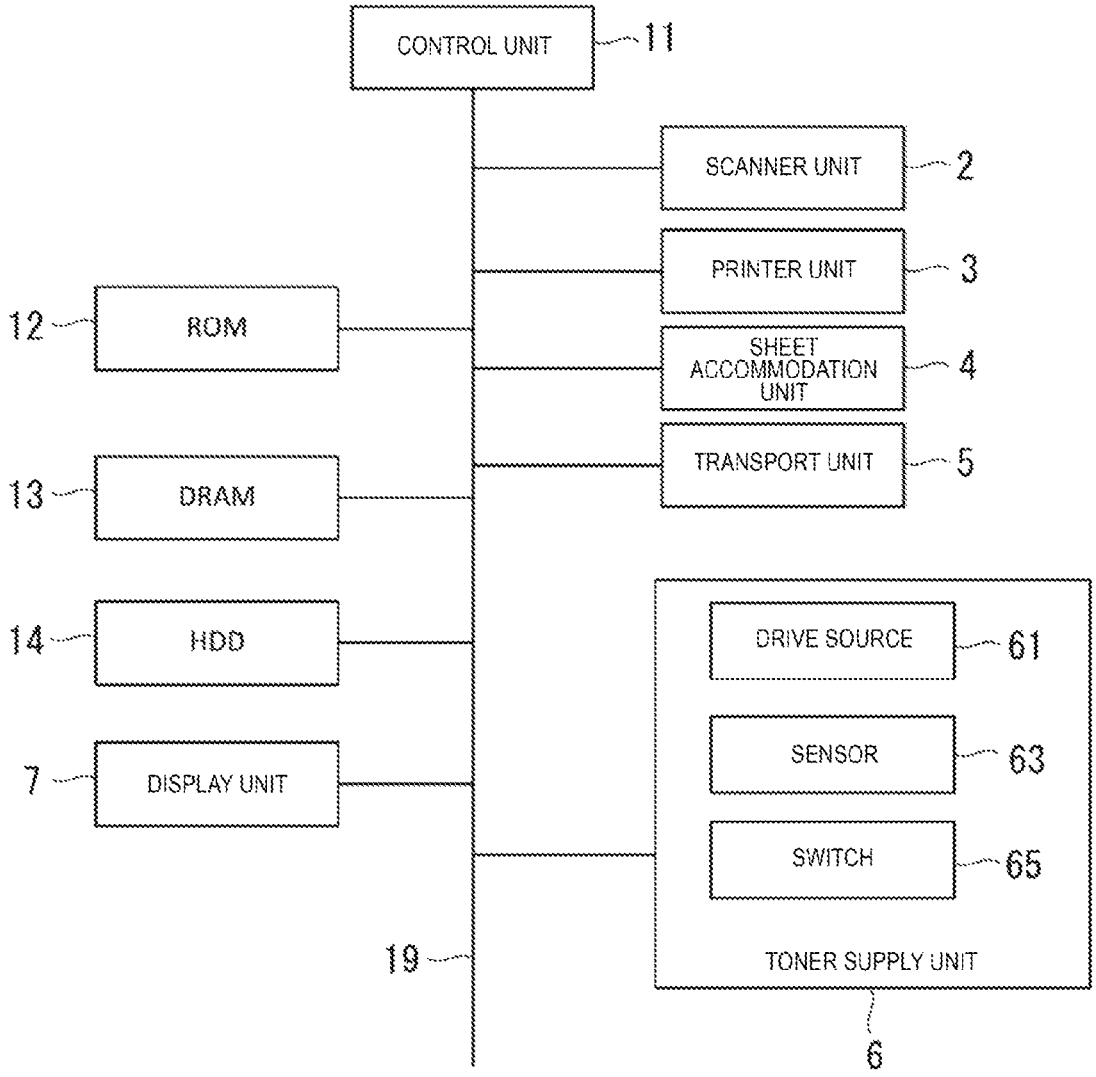
FIG. 2 is a schematic block diagram of an image forming apparatus according to the embodiment.

A cartridge is mounted in the toner supply unit 6. The cartridge can be a developer cartridge that separately accommodates the developer and the toner or a toner cartridge that accommodates only toner. The toner supply unit 6 has stations 6Y, 6M, 6C, and 6K which accommodate the cartridges. The developer cartridge or the toner cartridge accommodating the yellow toner is mounted on the station 6Y. The developer cartridge or the toner cartridge accommodating the magenta toner is mounted on the station 6M. The developer cartridge or the toner cartridge accommodating the cyan toner is mounted on the station 6C. The developer cartridge or the toner cartridge accommodating the black toner is mounted on the station 6K. As shown in FIG. 2, the toner supply unit 6 has a drive source 61, a sensor 63, and a switch 65. The drive source 61 drives the cartridge. The sensor 63 detects a position of a sealing member 136. The switch 65 identifies the type of the cartridge mounted in the toner supply unit 6. A configuration of the cartridges will be described later.

FIG. 2 is a schematic block diagram of the image forming apparatus according to the embodiment.

As illustrated in FIG. 2, the image forming apparatus 1 further includes a ROM 12, a DRAM 13, and a hard disk drive (HDD) 14. The respective functional units are connected to each other so as to enable data communication via a system bus 19. The scanner unit 2, the printer unit 3, the sheet accommodation unit 4, the transport unit 5, and the toner supply unit 6 include a sensor controlled by the control unit 11 or a device such as a drive source (motor). For example, in the devices included in the toner supply unit 6, the drive source 61, the sensor 63, and the switch 65 are connected to the system bus 19. Each of these devices is controlled by the control unit 11.

The control unit 11 controls each device connected thereto via the system bus 19. The ROM 12 stores various control programs required for the operation of the control unit 11. The DRAM 13 is used as a temporary data storage region when the control unit 11 executes the programs. The HDD 14 stores data used for the control. For example, the HDD 14 stores a reference value of the toner ratio concentration inside the developing device. For example, the HDD 14 stores various messages to be displayed on the display unit 7. For example, the HDD 14 stores data obtained by causing the control unit 11 to execute the programs.

Figure 3:
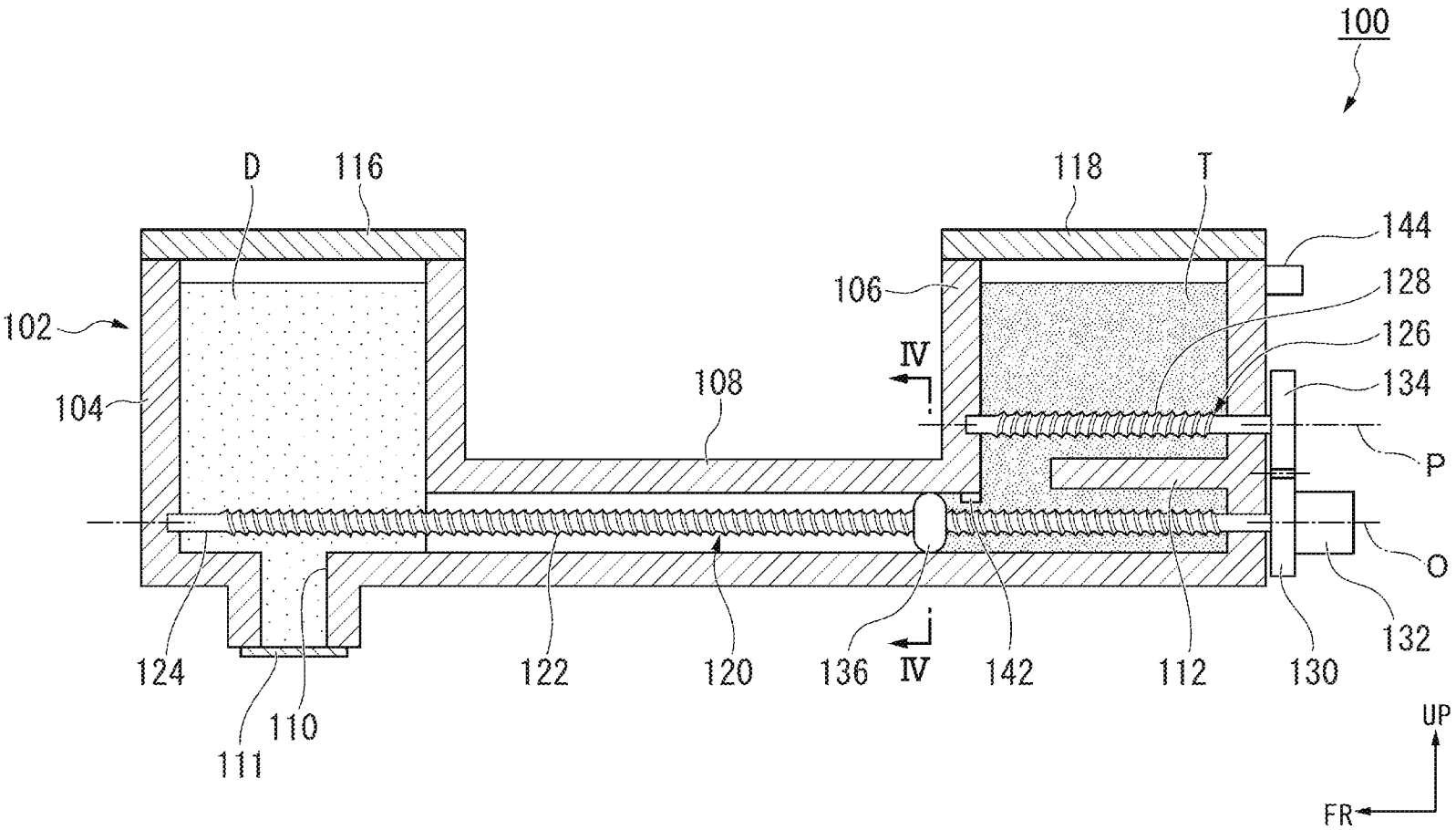
FIG. 3 is a schematic cross-sectional view of a developer cartridge according to the embodiment.

FIG. 3 is a schematic sectional view of a developer cartridge 100 according to the embodiment. Hereinafter, the developer cartridge 100 serving as the cartridge mounted in the toner supply unit 6 will be described. When the developer cartridge 100 is mounted in the toner supply unit 6, a longitudinal direction parallel to a length of the developer cartridge 100 coincides with the longitudinal direction of the image forming apparatus 1. The arrow labeled "UP" in FIG. 3 indicates an upward direction along the vertical direction of the image forming apparatus 1, and the arrow labeled "FR" indicates a forward direction along the longitudinal direction of the image forming apparatus 1.

As illustrated in FIG. 3, the developer cartridge 100 has a case 102, a first cover 116, a second cover 118, a first auger 120, a second auger 126, a first auger drive gear 130, a second auger drive gear 134, a sealing member 136, a regulation unit 142, also referred to as a stopper, and an identification unit 144, also referred to as a detection protrusion in some contexts.

The case 102 includes a developer storage chamber 104, which accommodates a developer D, a toner storage chamber 106, which accommodates a toner T, and a fluid communication path 108 through which the inside of the developer storage chamber 104 and the inside of the toner storage chamber 106 can communicate with each other. That is, the inside of the developer storage chamber 104 and the inside of the toner storage chamber 106 are physically connectable to each other via the fluid communication path 108.

The developer storage chamber 104 is disposed on the front most side of the case 102. The developer storage chamber 104 is formed in a box shape which opens upward. A discharge port 110 which discharges the developer D is formed on a bottom surface of the developer storage chamber 104. The discharge port 110 extends in the vertical direction at the bottom of the case 102. A lower end opening portion of the discharge port 110 is disposed at a lower surface of the case 102. A shutter which can regulate the discharge of the developer D may be disposed inside the discharge port 110. A hermetic seal 111, which closes the discharge port 110, may adhere to an edge of the lower end opening portion of the discharge port 110. The hermetic seal 111 is detached before the developer cartridge 100 is mounted in the toner supply unit 6.

The toner storage chamber 106 is disposed rearward of the developer storage chamber 104. The toner storage chamber 106 is disposed on the rear most side of the case 102. The toner storage chamber 106 is formed in a box shape which opens upward. A partition wall 112 is disposed inside the toner storage chamber 106. The partition wall 112 extends forward from a rear wall surface of the toner storage chamber 106. A front-end edge of the partition wall 112 is separated from a front wall surface of the toner storage chamber 106. The partition wall 112 need not be disposed in the toner storage chamber 106 in some embodiments.

The fluid communication path 108 is disposed between the developer storage chamber 104 and the toner storage chamber 106. The fluid communication path 108 extends in the longitudinal direction. A front-end portion of the fluid communication path 108 is connected to a lower end portion of the developer storage chamber 104. A rear-end portion of the fluid communication path 108 is connected to a lower end portion of the toner storage chamber 106. The inner surface of the fluid communication path 108 is uniformly formed in the longitudinal direction.

Figure 4:
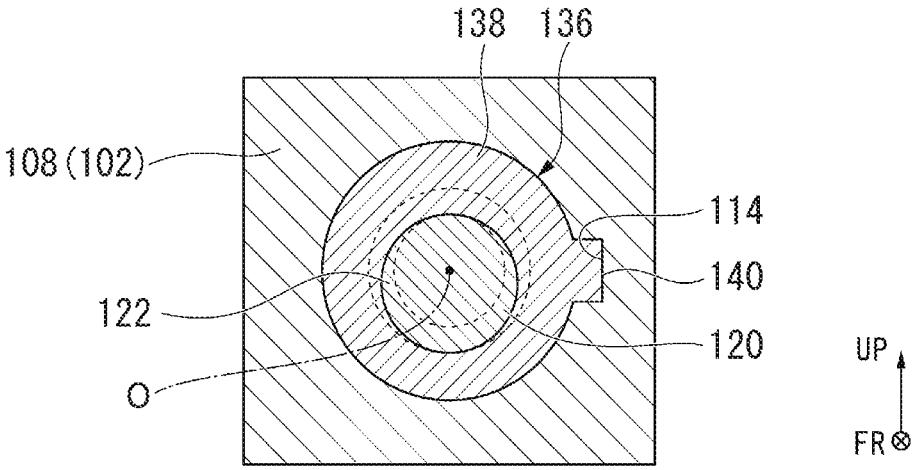
FIG. 4 is a cross-sectional view taken along line IV-IV in FIG. 3.

FIG. 4 is a sectional view taken along the line IV-IV in FIG. 3.

As illustrated in FIG. 4, the inner surface of the fluid communication path 108 is formed in a non-circular shape when viewed in the longitudinal direction. A groove portion 114 is formed on the inner surface of the fluid communication path 108. The groove portion 114 receives a convex portion 140 of the sealing member 136. The groove portion 114 extends continuously from the inner surface of the fluid communication path 108 to the inner surface of the developer storage chamber 104.

As illustrated in FIG. 3, the first cover 116 is disposed in an upper portion of the developer storage chamber 104. The first cover 116 closes an opening in the upper portion of the developer storage chamber 104.

The second cover 118 is disposed in an upper portion of the toner storage chamber 106. The second cover 118 closes an opening in the upper portion of the toner storage chamber 106.

The first auger 120 is a rod-like member extending in the longitudinal direction. The first auger 120 is inserted into the fluid communication path 108. The first auger 120 is disposed so as to be rotatable around a first rotation axis O extending in the longitudinal direction. A front-end portion of the first auger 120 is rotatably supported by a front wall portion of the developer storage chamber 104. A rear-end portion of the first auger 120 is rotatably supported by a rear wall portion of the toner storage chamber 106 below the partition wall 112.

A rotary vane 122 is disposed in the outer periphery of the first auger 120. The rotary vane 122 spirally extends around the first rotation axis O. The rotary vane 122 is disposed continuously between the toner storage chamber 106 and the developer storage chamber 104 through the inside of the fluid communication path 108. A front-end of the rotary vane 122 is located between the discharge port 110 and the front wall portion of the developer storage chamber 104. The first auger 120 has a small diameter portion 124 on a front side of the rotary vane 122. The small diameter portion 124 is a portion of the first auger 120 located inside the developer storage chamber 104, and is a portion having no rotary vane 122. The first auger 120 transports the toner T forward by normally rotating around the first rotation axis O.

The second auger 126 is a rod-like member extending in the longitudinal direction. The second auger 126 is located inside the toner storage chamber 106. The second auger 126 is located above the first auger 120. The second auger 126 is located above the partition wall 112. The second auger 126 is disposed so as to be rotatable around a second rotation axis P extending in the longitudinal direction. The front-end portion of the second auger 126 is rotatably supported by the front wall portion of the toner storage chamber 106. A rear-end portion of the second auger 126 is rotatably supported by the rear wall portion of the toner storage chamber 106.

A rotary vane 128 is disposed in the outer periphery of the second auger 126. The rotary vane 128 spirally extends around the second rotation axis P. The rotary vane 128 is disposed through the entire portion of the toner storage chamber 106. The second auger 126 transports the toner T forward by normally rotating around the second rotation axis P.

The first auger drive gear 130 is disposed outside the case 102. The first auger drive gear 130 is disposed coaxially with the first auger 120. The first auger drive gear 130 is attached to the rear-end portion of the first auger 120. The first auger drive gear 130 has a coupler 132 connected to the drive source 61 shown in FIG. 2.

The second auger drive gear 134 is disposed outside the case 102. The second auger drive gear 134 is disposed coaxially with the second auger 126. The second auger drive gear 134 is attached to the rear-end portion of the second auger 126. The second auger drive gear 134 meshes with the first auger drive gear 130. In this manner, the first auger 120 and the second auger 126 are synchronously rotated.

Figure 5:
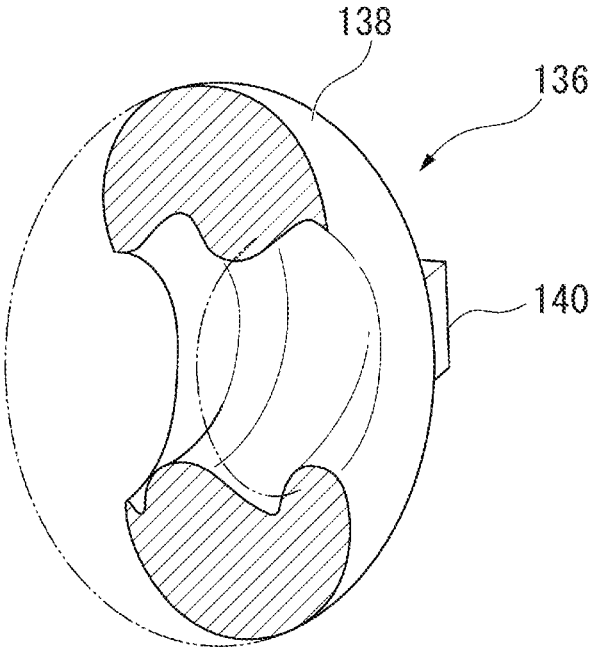
FIG. 5 is a perspective view of a sealing member according to the embodiment.

FIG. 5 is a perspective cross-sectional view of the sealing member according to the embodiment.

As illustrated in FIGS. 3 to 5, the sealing member 136 is formed in an annular shape. The sealing member 136 is formed of an elastic material such as rubber. The sealing member 136 surrounds the first auger 120. The sealing member 136 is located in the rear-end portion inside the fluid communication path 108 before the sealing member 136 is mounted in the toner supply unit 6 of the developer cartridge 100. When located inside the fluid communication path 108, the sealing member 136 closes a portion between the outer peripheral surface of the first auger 120 and the inner surface of the fluid communication path 108. The inner peripheral surface of the sealing member 136 is formed in a shape conforming to a shape of the outer peripheral surface of the rotary vane 122 of the first auger 120.

As illustrated in FIG. 4, the sealing member 136 has an annular main body 138 and a convex portion 140 erected on the outer peripheral surface of the main body 138. In this manner, the outer shape of the sealing member 136 when viewed from the longitudinal direction is formed into a non-circular shape. The convex portion 140 protrudes from the outer peripheral surface of the main body 138 along a radial direction of the main body 138. The convex portion 140 enters the groove portion 114 formed in the inner surface of the case 102. In this manner, the sealing member 136 is regulated in rotating around the first rotation axis O.

As illustrated in FIG. 3, the sealing member 136 surrounds the rotary vane 122, and thus the sealing member 136 moves along the longitudinal direction in response to the rotation of the first auger 120. The sealing member 136 moves forward due to the normal rotation of the first auger 120. The sealing member 136 disengages from the first auger 120 on the front side of the rotary vane 122 at the small diameter portion 124 of the first auger 120.

The regulation unit 142 prevents the movement of the sealing member 136 into the inside of the toner storage chamber 106 from the inside of the fluid communication path 108. The regulation unit 142 is disposed in the rear-end portion of the fluid communication path 108. For example, the regulation unit 142 is a protrusion disposed on the inner surface of the fluid communication path 108. The regulation unit 142 stops rearward movement of the sealing member 136 by blocking a portion the fluid communication path 108.

The identification unit 144 identifies a type of the cartridge. Specifically, the identification unit 144 permits the image forming apparatus 1 to detect that the cartridge mounted in the toner supply unit 6 is a developer cartridge 100. For example, the identification unit 144 is a protrusion disposed in the rear-end portion of the case 102. In this case, the identification unit 144 presses the switch 65 shown in FIG. 2 disposed in the toner supply unit 6, when the developer cartridge 100 is mounted in the toner supply unit 6. In this manner, the identification unit 144 detects that the developer cartridge 100 is mounted in the toner supply unit 6.

Next, an operation of the developer cartridge 100 according to the present embodiment will be described.

FIGS. 6 to 9 are views for describing the operation of the developer cartridge according to the embodiment.

When the developer cartridge 100 is mounted in the toner supply unit 6, the developer D accommodated inside the developer storage chamber 104 is discharged from the discharge port 110 by means of free fall (gravity). In this manner, the developer D is supplied to the developing device of the image forming unit 25. At this time, the control unit 11 causes the HDD 14 to store the toner ratio concentration detected by the toner concentration sensor 32 as a reference value of the toner ratio concentration.

Figure 6:
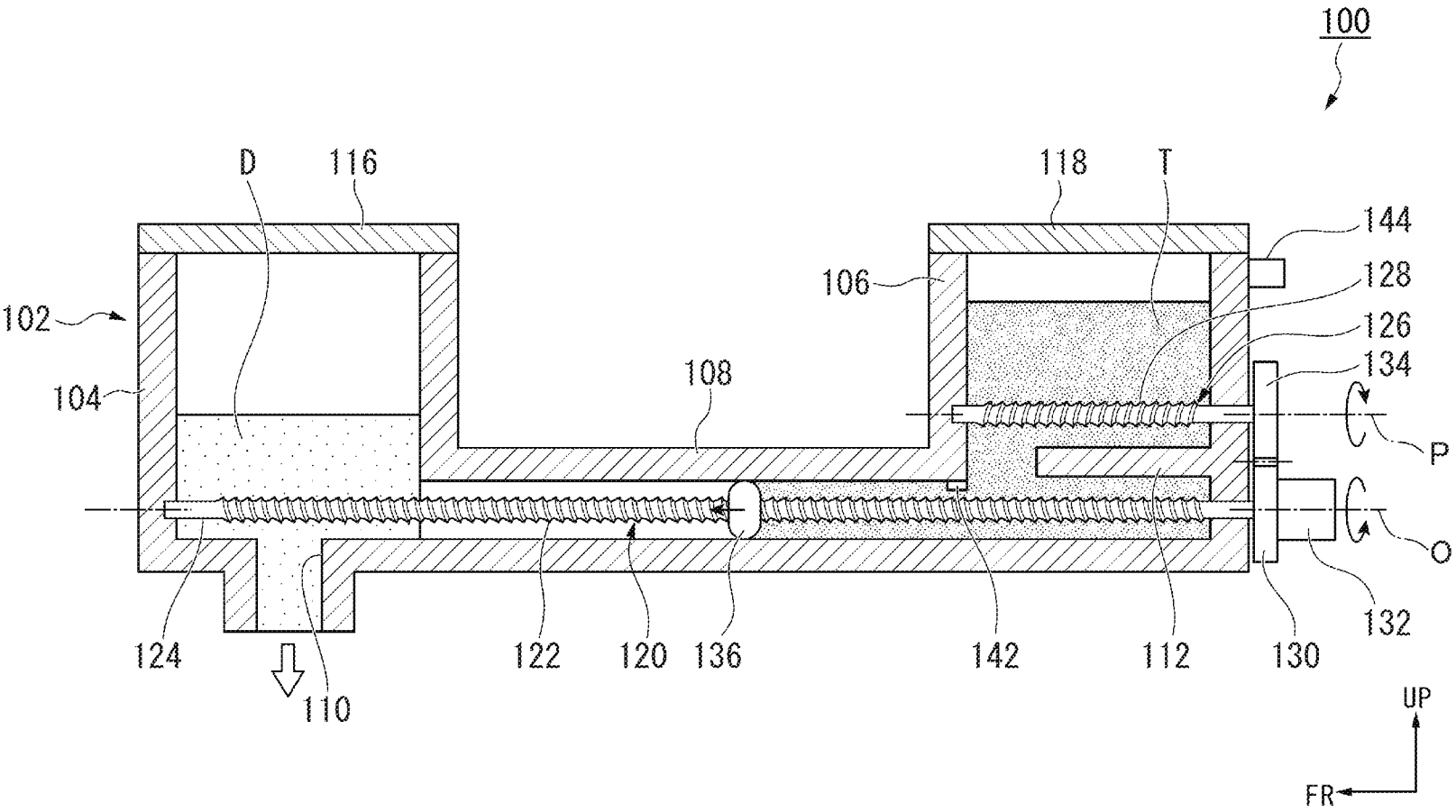
FIG. 6 is a cross-sectional view of a developer cartridge according to the embodiment.
Figure 7:
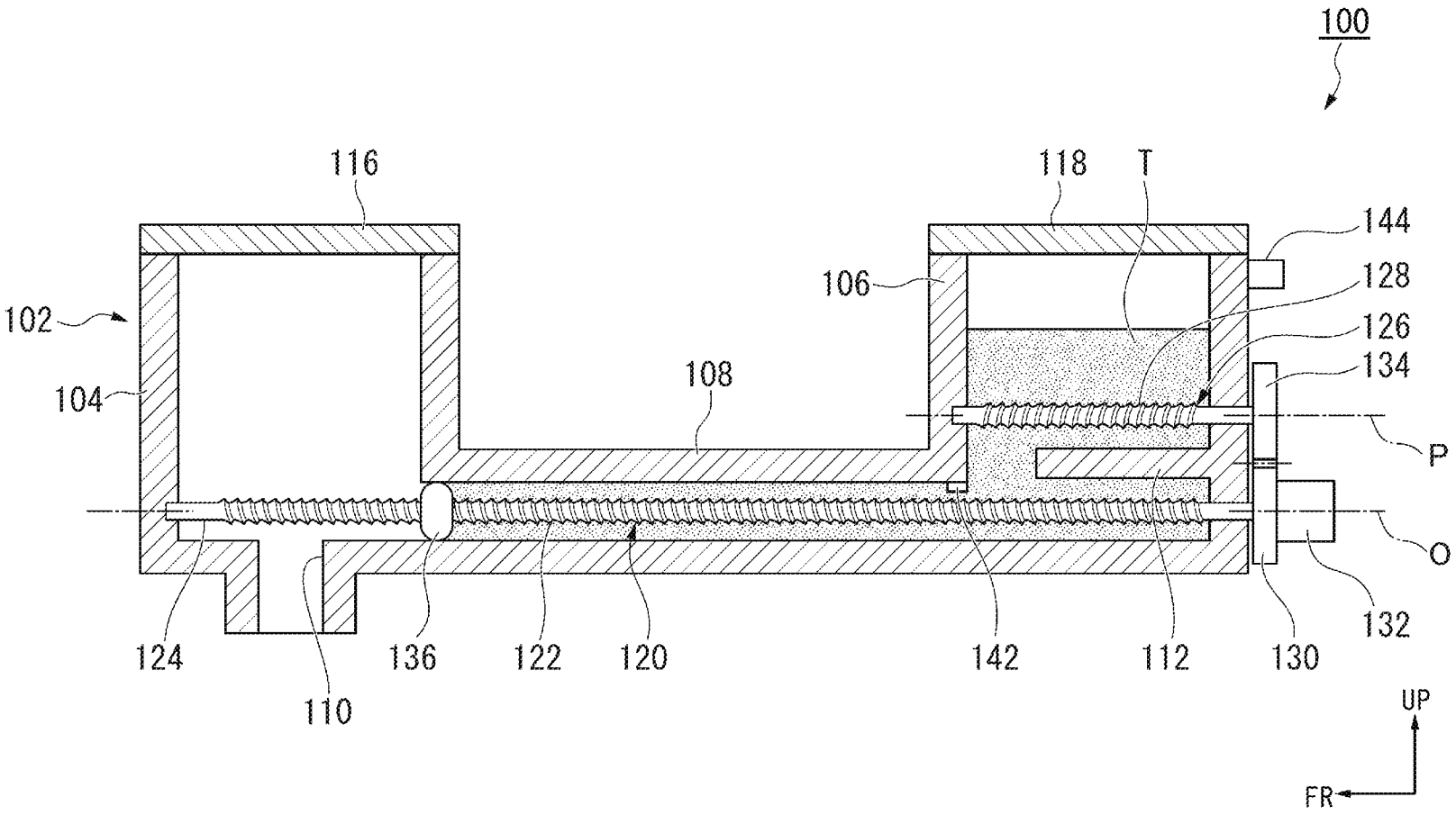
FIG. 7 is a cross-sectional view of a developer cartridge according to the embodiment.

The control unit 11 causes the first auger 120 to be normally rotated by the drive source 61, when the developer D is discharged from the discharge port 110. As illustrated in FIG. 6, when the first auger 120 is normally rotated, the first auger 120 moves the sealing member 136 in the forward direction from the rear end portion inside the fluid communication path 108, and moves the toner T accommodated in the toner storage chamber 106 forward. The toner T accommodated inside the fluid communication path 108 is prevented from moving past the sealing member 136 by the sealing member 136. In this manner, the control unit 11 causes the sealing member 136 and the toner T to move from the toner storage chamber 106 side to the developer storage chamber 104 side inside the fluid communication path 108.

The control unit 11 causes the first auger 120 to stop rotating after a predetermined time elapses from when the drive source 61 starts rotating the first auger 120. The predetermined time represents a time required for the sealing member 136 to move from the inside of the communication unit 108 to the inside of the developer storage chamber 104. Specifically, the predetermined time is a time required for the sealing member 136 to reach the front-end portion inside the fluid communication path 108. In this manner, the control unit 11 can cause the transportation of the toner T to stop immediately before the toner T enters the inside of the developer storage chamber 104.

Figure 8:
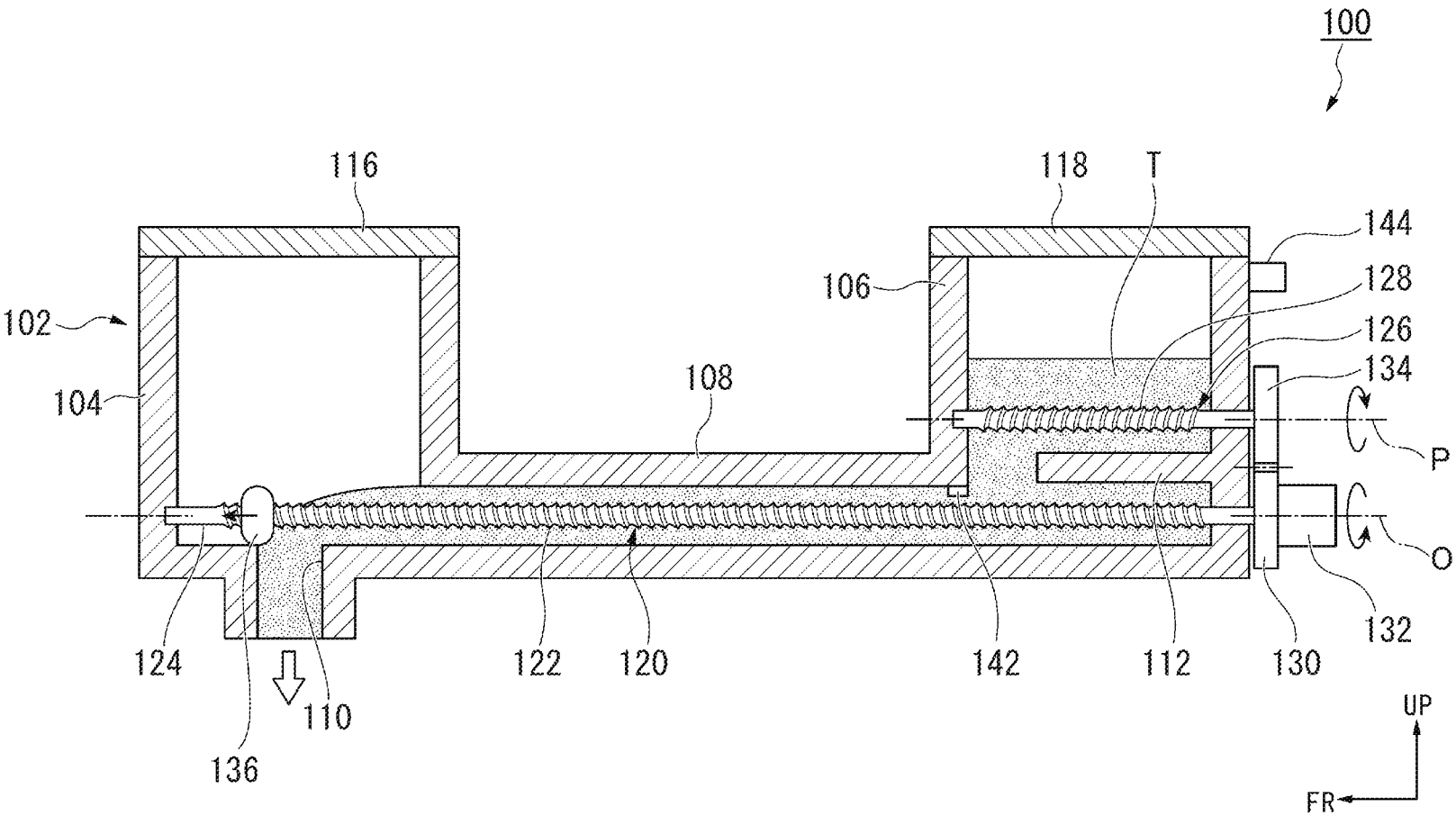
FIG. 8 is a cross-sectional view of a developer cartridge according to the embodiment.

The control unit 11 causes the first auger 120 to normally rotate if the toner ratio concentration detected by the toner concentration sensor 32 is smaller than the reference value of the toner ratio concentration read from the HDD 14. The control unit 11 causes the sealing member 136 to enter the inside of the developer storage chamber 104 as illustrated in FIG. 8. In this manner, the toner T is transported from the inside of the fluid communication path 108 into the developer storage chamber 104, and is discharged from the discharge port 110.

Figure 9:
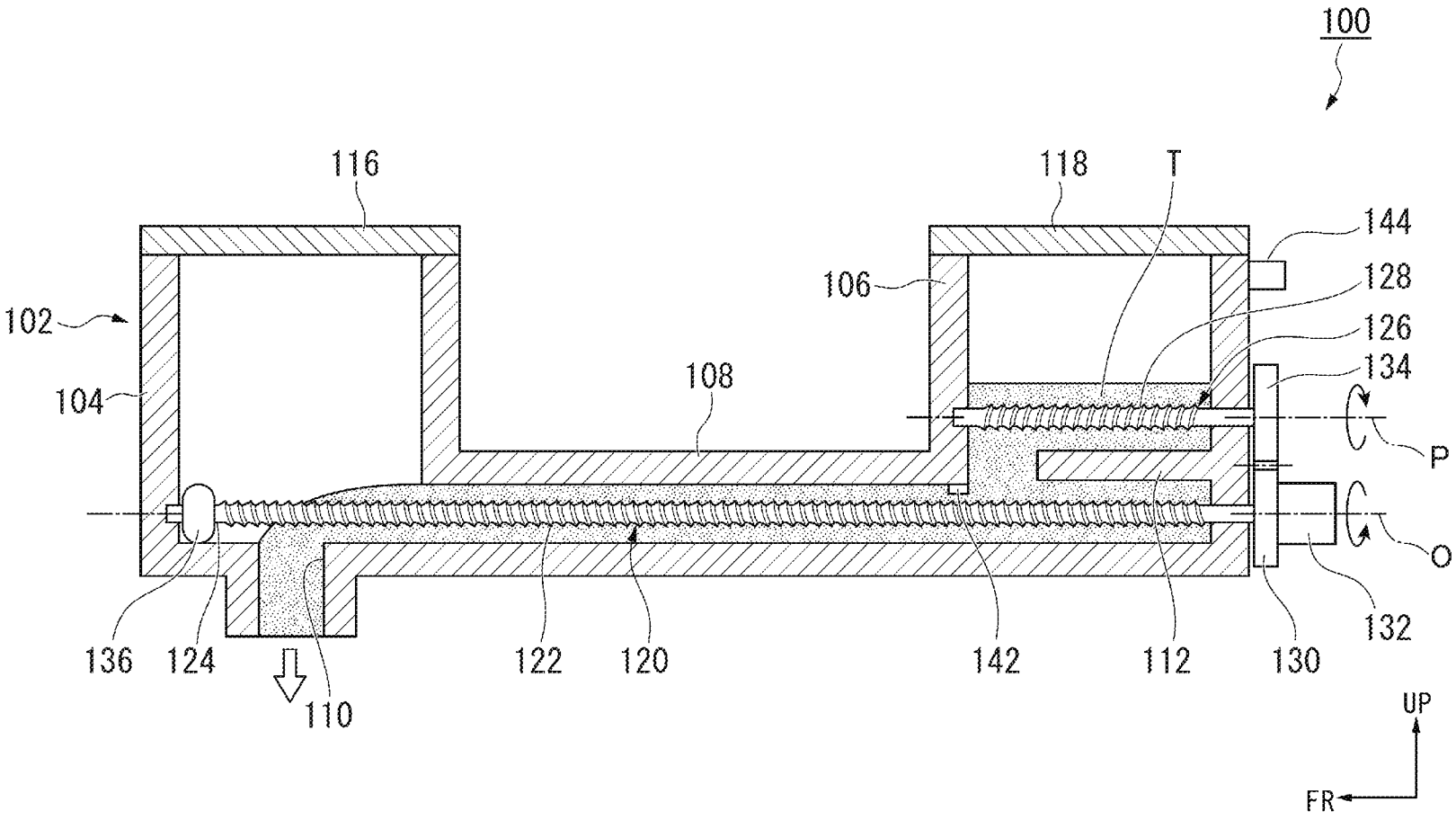
FIG. 9 is a cross-sectional view of a developer cartridge according to the embodiment.

If the sealing member 136 moves forward in response to the normal rotation of the first auger 120 as illustrated in FIG. 9, the sealing member 136 reaches the small diameter portion 124 of the first auger 120. The sealing member 136 disengages from the first auger 120 in the longitudinal direction in the small diameter portion 124. Therefore, if the sealing member 136 reaches the small diameter portion 124, the sealing member 136 completes the movement in the longitudinal direction.

According to the present embodiment, the developer cartridge 100 has the developer storage chamber 104, the toner storage chamber 106, the fluid communication path 108, the first auger 120, and the sealing member 136. The discharge port 110 is formed in the developer storage chamber 104. The fluid communication path 108 causes the developer storage chamber 104 and the toner storage chamber 106 to internally communicate with each other. The first auger 120 is inserted into the fluid communication path 108, and the toner is transported toward the developer storage chamber 104. The sealing member 136 surrounds the first auger 120, and closes the portion between the outer peripheral surface of the first auger 120 and the inner surface of the fluid communication path 108, when the sealing member 136 is located in the fluid communication path 108. The sealing member 136 moves along the longitudinal direction inside the fluid communication path 108 in response to the rotation of the first auger 120.

According to this configuration, the developer cartridge 100 can accommodate both the developer D and the toner T. The sealing member 136 can regulate the movement of the toner T into the developer storage chamber 104 from the inside of the toner storage chamber 106 through the inside of the fluid communication path 108. Therefore, it is possible to prevent the developer D and the toner T from being mixed with each other inside the developer cartridge 100. Furthermore, the first auger 120 is rotated, thereby enabling the sealing member 136 to move into the developer storage chamber 104 from the inside of the fluid communication path 108. Therefore, the toner T can be discharged from the discharge port 110 by transporting the toner T into the developer storage chamber 104. According to the above-described configuration, the developer D and the toner T can be accommodated in the developer cartridge 100 while the developer D and the toner T can be prevented from being mixed with each other inside the developer cartridge 100.

The inner surface of the sealing member 136 is formed in a shape conforming to a shape of the outer peripheral surface of the first auger 120. Therefore, it is possible to prevent a gap from being formed between the sealing member 136 and the first auger 120. The sliding resistance of the sealing member 136 and the first auger 120 can be reduced compared to a case where the sealing member is brought into close contact with the outer peripheral surface of the first auger 120 due to the elastic deformation of the sealing member. Therefore, the sealing member 136 can smoothly move relative to the first auger 120 without increasing the output of the drive source 61.

The outer shape of the sealing member 136 is formed in a non-circular shape. Therefore, the sealing member 136 can engage with the inner surface of the fluid communication path 108 in the rotation direction of the first auger 120. Accordingly, the sealing member 136 can be prevented from rotating together with the first auger 120. Therefore, the sealing member 136 can move in the longitudinal direction in response to the rotation of the first auger 120.

The developer cartridge 100 has the regulation unit 142 which regulates the movement of the sealing member 136 into the toner storage chamber 106 from the inside of the fluid communication path 108. Accordingly, it is possible to prevent the toner T from entering the inside of the fluid communication path 108 from the toner storage chamber 106 after the sealing member 136 enters the inside of the toner storage chamber 106. Therefore, the developer D and the toner T can be prevented from being mixed with each other inside the developer cartridge 100.

The first auger 120 has the small diameter portion 124 having no rotary vane 122, in the portion located inside the developer storage chamber 104. Therefore, it is possible to stop the forward movement of the sealing member 136 inside the developer storage chamber 104. Accordingly, the sealing member 136 cannot be rotated after reaching the front-end portion while engaging with the rotary vane 122, and thus, it is possible to prevent a possibility that the first auger 120 cannot be rotated. Therefore, even after the sealing member 136 is completely moved, the first auger 120 can continuously transport the toner T.

The sealing member 136 is formed of an elastic material. Therefore, the sealing member 136 can be brought into close contact with the outer peripheral surface of the first auger 120 and the inner surface of the fluid communication path 108. Accordingly, the sealing member 136 reliably closes the portion between the outer peripheral surface of the first auger 120 and the inner surface of the fluid communication path 108. Therefore, the developer D and the toner T can be prevented from being mixed with each other inside the developer cartridge 100.

The developer cartridge 100 includes the identification unit 144 which identifies the type of the cartridge. Therefore, for example, if the toner cartridge is mounted when the developer cartridge 100 should be mounted in the toner supply unit 6, a user can be notified of the erroneous mounting.

When the developer D is discharged from the discharge port 110, the control unit 11 causes the sealing member 136 to move from the toner storage chamber 106 side to the developer storage chamber 104 side inside the fluid communication path 108. Therefore, after the developer D is completely discharged, the sealing member 136 is allowed to quickly enter the developer storage chamber 104. In this manner, the toner T can be quickly transported into the developer storage chamber 104.

The control unit 11 stops the rotation of the first auger 120 after a predetermined time elapses from when the first auger 120 starts to be rotated. Therefore, the predetermined time is set in advance according to a dimension of the fluid communication path 108, thereby enabling the sealing member 136 to be stopped in the end portion on the developer storage chamber 104 side inside the fluid communication path 108. Accordingly, after the developer D is completely discharged, the sealing member 136 is allowed to quickly enter the inside of the developer storage chamber 104. In this manner, the toner T can be quickly transported into the developer storage chamber 104.

In the above-described embodiment, the control unit stops the rotation of the first auger 120 after the predetermined time elapses from when the first auger 120 starts to be rotated. However, a configuration is not limited thereto. The control unit 11 may cause the sensor 63 to detect a position of the sealing member 136, and may cause the first auger 120 to stop rotating before the sealing member 136 enters the inside of the developer storage chamber 104. In this manner, the sealing member 136 is allowed to quickly enter the inside of the developer storage chamber 104 after the developer D is completely discharged. Therefore, the toner T can be quickly transported into the developer storage chamber 104.

A material of the sealing member 136 is not limited to the elastic material. For example, the sealing member may be formed of a hard resin or a metal material.

In the above-described embodiment, the developer cartridge 100 includes the second auger 126, but some embodiments need not include a second auger 126.

An outer shape of the sealing member 136 is not limited to the shape according to the above-described embodiment. The sealing member of other shape may be prevented from rotating together with the first auger 120.

According to the examples described above, the developer cartridge has a developer storage chamber, a toner storage chamber, a communication unit, a first auger, and the sealing member. The discharge unit is formed in the developer storage chamber. The communication unit permits the developer storage chamber and the toner storage chamber to internally communicate with each other (provides a physical pathway between the two units). The first auger is inside the communication unit, and transports the toner towards the developer storage chamber. The sealing member is attached to the first auger, and closes an opening/gap between the outer peripheral surface of the first auger and the inner surface of the communication unit, when the sealing member is located in the communication unit. The sealing member moves along the longitudinal direction inside the communication unit with the rotation of the first auger. According to this configuration, the developer cartridge can store both the developer and the toner. The sealing member can regulate amount of the toner provided to o the developer storage chamber from the toner storage chamber. Accordingly, the developer and the toner can be prevented from being undesirably mixed with each other inside the developer cartridge. Furthermore, the first auger is rotated, thereby enabling the sealing member to move into the developer storage chamber from the inside of the communication unit. Therefore, the toner can be transported into the developer storage chamber, and the toner can be discharged from the discharge unit. According to the above-described configurations, the developer and the toner can be accommodated in the developer cartridge while the developer and the toner can be prevented from being mixed with each other inside the developer cartridge.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A cartridge for mounting in an image forming apparatus, comprising:

a developer storage chamber in which a developer can be stored;

a discharge port connected to the developer storage chamber;

a toner storage chamber in which a toner can be stored;

a path connecting the toner storage chamber and the developer storage chamber;

a sealing member that is movable and configured to seal a gap between the sealing member and an inner surface of the path; and a rod that is rotatable inside the path about a rotation axis and configured to transport the sealing member along the path between the toner storage chamber and the developer storage chamber when rotated about the rotation axis.

2. The cartridge according to claim 1, wherein an outer surface of the sealing member has a shape conforming to the inner surface of the path.

3. The cartridge according to claim 1, wherein a cross-section of an outer shape of the sealing member has a non-circular shape.

4. The cartridge according to claim 1, wherein a cross-section of an inner shape of the path has a non-circular shape.

5. The cartridge according to claim 1, wherein the sealing member is disposed on the rod.

6. The cartridge according to claim 5, wherein the sealing member is configured to seal a gap between the sealing member and the rod.

7. The cartridge according to claim 6, wherein an inner surface of the sealing member has a shape conforming to an outer surface of the rod.

8. The cartridge according to claim 1, wherein the rod has a reduced diameter portion located inside the developer storage chamber.

9. The cartridge according to claim 1, further comprising:

a rotary vane on an outer periphery of the rod, the rotary vane spirally extending around the rotation axis between a first point inside the developer storage chamber and a second point inside the toner storage chamber.

10. The cartridge according to claim 9, wherein the sealing member surrounds the rotary vane.

11. The cartridge according to claim 1, further comprising:

a stopper configured to block movement of the sealing member along the path into the toner storage chamber.

12. The cartridge according to claim 1, wherein the sealing member comprises an elastic material.

13. The cartridge according to claim 1, further comprising:

a detection protrusion configured to provide an identification of the cartridge.

14. An image forming apparatus, comprising:

a developer storage chamber in which a developer can be stored;

a discharge port connected to the developer storage chamber;

a toner storage chamber in which a toner can be stored;

a path extending from the toner storage chamber to the developer storage chamber in a first direction, the path connecting the toner storage chamber and the developer storage chamber;

a sealing member that is movable and configured to seal a gap between the sealing member and an inner surface of the path;

a rod that is rotatable inside the path about a rotation axis extending in the first direction and configured to transport the sealing member along the path between the toner storage chamber and the developer storage chamber when rotated about the rotation axis;

a drive source that rotates the rod; and a control unit configured to cause the drive source to rotate the rod to move the sealing member from a toner storage chamber side to a developer storage chamber side along the path to transport the toner from the toner storage chamber to the developer storage chamber and discharge the toner through the discharge port.

15. The image forming apparatus according to claim 14, wherein, when the developer is discharged through the discharge port, the control unit causes the drive source to stop the rotation of the rod after a predetermined time has elapsed from when the drive source starts the rotation of the rod to discharge the developer through the discharge port.

16. The apparatus according to claim 14, further comprising:

a sensor capable of detecting a position of the sealing member along the first direction, wherein, when the developer is discharged through the discharge port, the control unit causes and the drive source to stop the rotation of the rod before the sealing member enters the developer storage chamber, based on the position of the sealing member detected by the sensor.

17. The apparatus according to claim 14, wherein a cross-section of an outer shape of the sealing member in the first direction has a non-circular shape.

18. The apparatus according to claim 14, further comprising:

a stopper configured to block movement of the sealing member along the path into the toner storage chamber.

19. The apparatus according to claim 14, further comprising:

a rotary vane on an outer periphery of the rod, the rotary vane spirally extending around the rotation axis between a first point inside the developer storage chamber and a second point inside the toner storage chamber, wherein the sealing member surrounds the rotary vane, and the sealing member moves in the first direction in response to a rotation of the rod.

20. The apparatus according to claim 14, wherein the sealing member comprises an elastic material.

* * * * *